US005519972A

United States Patent [19]

Howie, Jr.

[11] Patent Number: 5,519,972

[45] Date of Patent: May 28, 1996

[54] DECORATIVE PRODUCT HAVING A DECORATIVE STRIP

[75] Inventor: Robert K. Howie, Jr., Decatur, Ill.

[73] Assignee: The Grigoleit Company, Decatur, Ill.

[21] Appl. No.: 391,136

[22] Filed: Feb. 21, 1995

Related U.S. Application Data

[62] Division of Ser. No. 116,451, Sep. 3, 1993.

[51] Int. Cl.[6] ..... B44F 7/00

[52] U.S. Cl. ..... 52/312; 52/717.04

[58] Field of Search ..... 52/312, 716.5, 52/716.8, 717.04, 717.05, 717.06

[56] References Cited

U.S. PATENT DOCUMENTS

| | | | |
|---|---|---|---|
| 3,071,047 | 1/1963 | Bentfield | 29/450 |
| 3,843,475 | 10/1974 | Kent | 52/312 X |
| 4,235,949 | 11/1980 | van Manen | 52/312 X |
| 4,274,237 | 6/1981 | Hagstrom | 52/312 |
| 4,397,896 | 8/1983 | Moran | 52/716.5 X |
| 4,592,127 | 6/1986 | Simon | 29/451 |
| 5,049,346 | 9/1991 | Yada et al. | 29/451 X |
| 5,093,976 | 3/1992 | Malinow et al. | 29/451 |
| 5,123,211 | 6/1992 | Schlicht et al. | 29/449 X |

FOREIGN PATENT DOCUMENTS

| | | | |
|---|---|---|---|
| 3147300 | 6/1983 | Germany | 428/542.2 |
| 756337 | 9/1956 | United Kingdom | 29/446 |

*Primary Examiner*—Carl D. Friedman
*Assistant Examiner*—Beth A. Aubrey
*Attorney, Agent, or Firm*—Dorn, McEachran, Jambor & Keating

[57] ABSTRACT

This invention is directed to a method of inserting an elongated, thin, flexible strip of a material of limited resiliency into a recess in a base member. The method includes the steps of slightly bowing the ends of the strip away from the base member and inserting one end of the elongated strip into the recess of the base member under a lip or overhang located at the end of the recess. The next step involves supporting a middle portion of the strip above the recess while retaining the first end of the strip in the recess. The method then includes the step of inserting the other end of the strip in the opposite end of the recess adjacent a lip or overhang and removing the support for the middle portion of the strip to allow the middle portion of the strip to seat in the recess while moving under the lip or overhang under its own resiliency. The decorative product which may be formed by this process has a strip trapped in a recess by engagement of its ends with lips extending over the recess. One end of the strip may be anchored at one end by one or more glue spots or tabs gouged or otherwise formed from the base to accommodate differential expansion of the strip and the base.

4 Claims, 2 Drawing Sheets

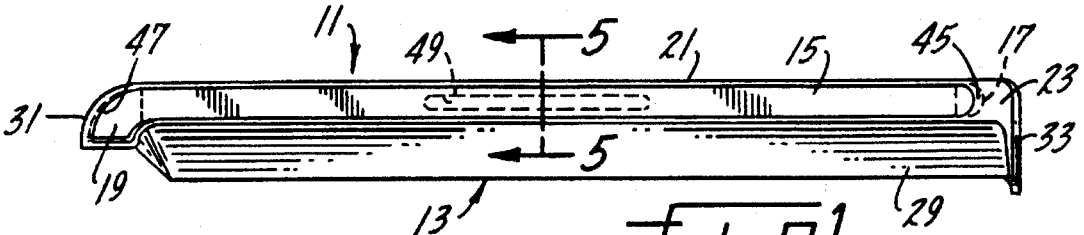
Fig. 1.
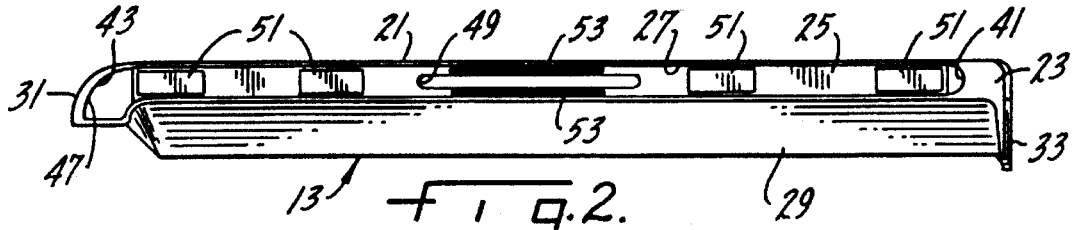
Fig. 2.
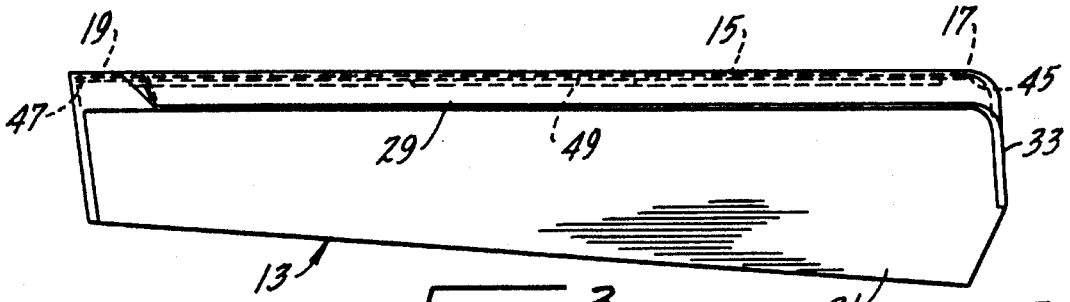
Fig. 3.
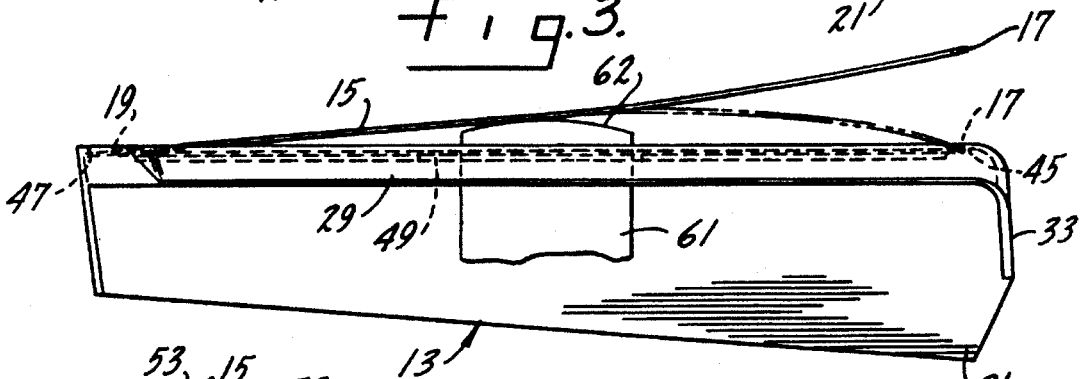
Fig. 4.
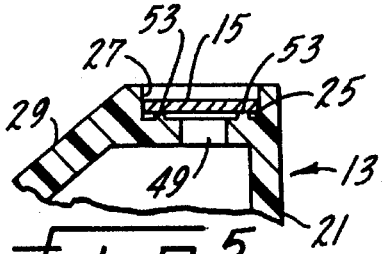
Fig. 5.
Fig. 6.
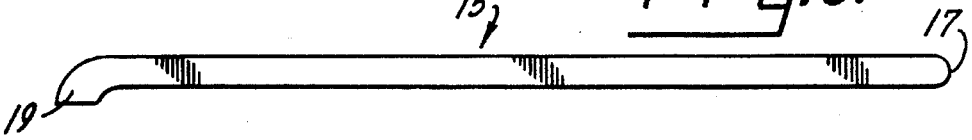

DECORATIVE PRODUCT HAVING A DECORATIVE STRIP

This is a division of co-pending application Ser. No. 08/116,451, filed Sep. 3, 1993.

BACKGROUND AND SUMMARY OF THE INVENTION

The manual assembly of thin, flexible strips of material of limited resiliency such as strips of polished aluminum to a plastic base member requires great dexterity on the part of the assembler primarily because of the tendency of said strips to be permanently deformed by even the slightest overbending which may create a permanent crease in the strip. The assembly of such a strip with a base usually involves the seating of a perfectly flat strip in a recess formed in the base. With a flat strip, adhesives were necessary to attach the strip to the base so that it would lie flat and would not shift around or lift. In accordance with the teachings of this invention, a precisely pre-bowed strip is used with its ends bent outwardly relative to the base to provide an outwardly facing concave configuration relative to the base. The amount of bowing need not be large, only enough to provide some resiliency to hold the strip in the recess. The bowed ends of the precisely pre-bent strip are captured under lips or overhangs formed at the ends of the recess in the base member. Adhesives may still be applied, in a later step, to prevent removal of the strip after it has been assembled. Alternately, the plastic of the base member may be deformed against an end of the strip to fasten it in position. The elongated strip, after assembly, will be retained flush in the recess of the base member by engagement of the lips or overhangs of the base member with the bowed ends of the strip. The strip will appear to be lying flat and will not shift in the recess. However, if the strip is bent or stressed beyond its pre-bent condition during assembly it will not lie flat in the recess and will not remain attached to the base member in an attractive manner.

Because it is necessary for the assembler to bend the elongated strip in the direction opposite to that of the bowing to tuck the opposite ends of the strip under the lips or overhangs at the ends of the recess, the problem of overbending the strip and creating a permanent deformation in the strip is always present during assembling operations.

Accordingly, it is an object of this invention to provide a method of assembly of a strip of a material of limited resiliency such as a polished aluminum strip which will not result in the unwanted deformation of the strip.

Another object of this invention is a method of assembly of a strip of a material of limited resiliency which facilitates the assembly by providing a controlled amount of bending of the strip during assembly.

Another object of this invention is a method of assembling a decorative strip into the recess of a base member which does not require the exercise of judgment by the assembler as to the amount of bending of the decorative strip.

Yet another object of this invention is a method of assembly of a strip into the recess of a base member which does not require the use of a mechanical aid.

A further object of this invention is an appliance trim having a decorative strip seated in a recess which strip is anchored at one end to an overhang of the recess by a deformed portion of the base to allow for differential expansion of the strip and the base.

Still another object of this invention is an appliance trim having an elongated, decorative strip seated in a recess in a base member which strip is held in an apparently flat orientation by the engagement of its slightly bowed ends with overhangs at the ends of the recess.

Other objects of the invention will be found in the following specification, claims and drawings.

BRIEF DESCRIPTION OF THE DRAWINGS

The invention is illustrated more or less diagrammatically in the following drawings wherein:

FIG. 1 is a top plan view of an appliance trim with a decorative metal strip assembled in accordance with the teachings of this invention;

FIG. 2 is a top plan view of the base member of the appliance of FIG. 1;

FIG. 3 is a side elevational view of the assembled appliance trim of FIG. 1;

FIG. 4 is a side elevational view of the appliance trim showing the assembly of the decorative strip in the recess of the base member with an initial bowed position of the decorative strip shown in solid lines, an intermediate position of the strip shown in phantom lines and the final assembled position shown in dashed lines;

FIG. 5 is an enlarged cross sectional view taken along 5—5 of FIG. 1;

FIG. 6 is a top plan view of the decorative strip.

DESCRIPTION OF THE PREFERRED EMBODIMENT

Figure 7:
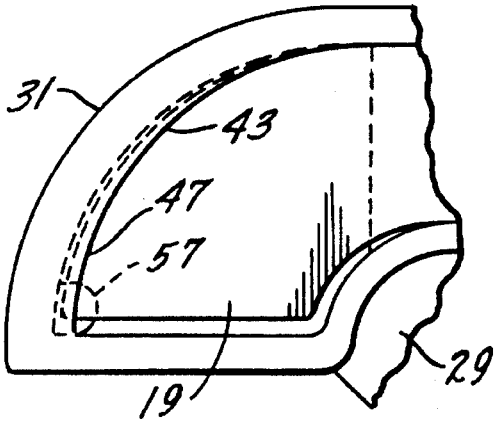
FIG. 7 is an enlarged, partial top plan view of the appliance trim of FIG. 1.

FIG. 1 of the drawing shows appliance trim 11 assembled in accordance with the teachings of this invention. The appliance trim includes a base member 13 formed of plastic and an attached decorative strip 15 formed of polished aluminum. As is shown most clearly in FIGS. 1 and 6 of the drawings, the strip 15 is rounded at one end 17 and is slightly hooked at the opposite end 19 thereof. The strip is bowed slightly. A bow of one-eighth to one-quarter of an inch for a strip that is approximately six inches in length has been found to be sufficient.

The plastic base member 13 includes a top wall 21 and a front wall 23. The front wall 23 has a setback portion 25 forming a recess 27. The front wall also has an inclined skirt portion 29. The top wall 21 has a curved portion 31 which forms one end wall of the member and the inclined skirt portion 29 has a curved portion 33 which forms an end wall and merges with the top wall 21.

Figure 8:
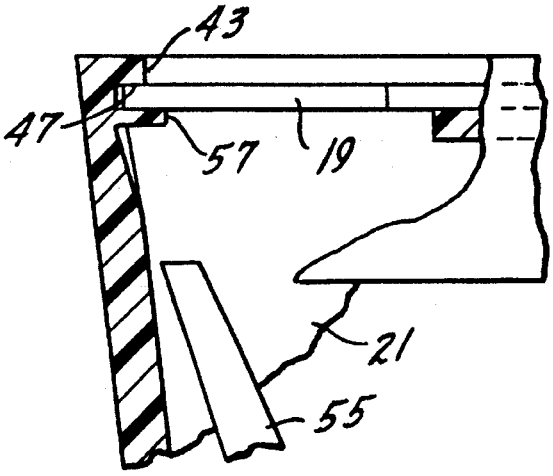
FIG. 8 is an enlarged, partial, cross sectional view showing a tool forming a bent over flap to secure the ornamental strip in the recess.

The setback wall portion 25 which forms the recess 27 has a somewhat semi-circular cutout 41 at the right-hand end as viewed in FIG. 2 of the drawings and a somewhat arcuate cutout 43 formed at the left-hand end of the recess also as viewed in FIG. 2. The front wall 23 of the base member includes an overhang 45 extending over the cutout 41. An arcuate lip 47 extends over the cutout 43 at the opposite end of the recess 27. The lip 47 projects only a slight distance from the end wall 31. To retain the hooked end 19 of the strip 15 in place against this lip in situations where there is longitudinal shifting of the strip due to differential expansion of the strip relative to the base member 13, an adhesive may be applied through the cutout 43 to the back surface of the end 19 of the strip and to the inside surface of the wall 23 below the arcuate lip 47. Alternately, as shown in FIGS. 7 and 8 of the drawings, a tool 55 may be used to gouge or otherwise deform the inside of the plastic wall 31 of the base and form a bent over flap 57 of plastic which secures the end 19 of the strip 15 against the underside of the curved lip 47. The overhang 45 at the opposite end of the recess 27 is considerably longer than the lip 47, that is, it extends longitudinally a greater distance from its end wall 33 than does the lip 47 from its end wall 31. Therefore, the rounded end 17 of the strip 15 extends a longer distance under its overhang 45 than does the end. 19 extend under its lip 47 while having additional space from the end wall 33 to take up any differential expansion between the strip 15 and the base member 13. Thus, when the end 19 of the strip 15 is assembled, the strip 15 is free to expand and contract without disengaging from the overhangs or changing the visual illusion that it is lying flat in the recess 27.

A thin, elongated slot 49 is formed in the center of the recess 27 and extends through the setback wall 25. Slightly raised seating pads 51 for the strip 15 are formed on the setback wall portion 25 with slightly raised ribs 53 located on opposite sides of the slot 49.

The practice of the method of this invention is shown with most clarity in FIG. 4 of the drawings. In practicing the method, the assembler inserts one end, in this instance the hooked end 19 of the slightly concavely bowed pre-bent decorated strip 15, under the curved lip 47 at one end of the recess 27. The center of the strip 15 rests on a member 61 which extends through the slot 49 in the setback wall portion 25 of the recess 27. The member 61 has an arcuate top portion 62 which engages and supports the strip inclined to the recess so that the assembler can bend the opposite end 17 of the strip down into the recess through the cutout 41 at the right-hand end of the recess as shown in phantom lines in FIG. 4 of the drawings. The member 61 is then retracted to allow the strip 15 to move under the overhang 45 and to seat, due to its resiliency provided by its concave bow, in the recess 27 on the pads 51 as shown in dashed lines.

The member 61 can be moved to and from its extending position as shown in FIG. 4 by any suitable electrical, mechanical, pneumatic or hydraulic mechanism. The amount of projection of the arcuate portion 62 of the member 61 beyond the set back wall portion 25 of the recess 27 is predetermined to allow the assembler to bend the strip 15 so that the other end of the strip can be hooked under the lip or overhang without permanently deforming the relatively non-resilient strip, which in this case is formed of a polished aluminum. The arcuate portion 62 has a convex surface facing the strip 15 which surface may vary in radius, but its radius will always be less than the radius of the strip 15 at their points of contact to avoid overbending or other permanent distortion of the strip 15.

It should be understood and appreciated that this method may also be useful with materials other than aluminum which have more than a limited amount of resiliency and wherein the problem of deformation is not present. Therefore, this method may also be used with the assembly of highly resilient strips of material which are difficult to handle since it provides an easy method for the assembler to simply hook one end of the strip under a lip or overhang and bend the other end about the member to insert it at the other end of a recess and then complete the assembly. Additionally, this method of assembly may be practiced by a skilled assembler without using the member 61. Instead, the skilled assembler may use his or her finger to maintain and then control the downward movement of the center of the strip 15 inclined to the recess 27 until the end 17 of the strip is caught under the overhang 45. Further, this method of assembly of this invention should not be limited to the assembly of appliance trim since it is adaptable to the assembly of practically any product having a strip which is held to a base by trapping the ends of the strip beneath overhangs at the ends of the base.

I claim:

1. An appliance trim, including:

an elongated base member formed of a thin-walled plastic having a front wall, a portion of said front wall being inset to form an elongated recess in said base member, portions of said front wall overhanging said recess at opposite longitudinal ends thereof, openings formed in said inset wall adjacent said overhangs, a passage formed in said inset wall between said overhang openings, and an elongated, thin, flexible strip of metal of limited resiliency having slightly bowed ends seated in said recess with its ends engaging said overhangs.

2. The appliance trim of claim 1 in which one of said overhangs is shorter than the other overhang, and means are provided to anchor said strip to said shorter overhang to maintain said strip in its seated position against movement caused by differential expansion on said strip and said base.

3. The appliance trim of claim 2 in which said means to anchor said strip to said shorter overhang is a flap of plastic formed from said base.

4. The appliance trim of claim 2 in which one of said overhangs is longer than the other with said longer overhang providing expansion room to accommodate the differential expansion and contraction of said strip and said base.

* * * * *